US006606022B1

(12) United States Patent
Taurand

(10) Patent No.: US 6,606,022 B1
(45) Date of Patent: Aug. 12, 2003

(54) PLANAR TRANSFORMER WINDING

(75) Inventor: Christophe Taurand, Valence (FR)

(73) Assignee: Sextant Avionique, Velizy Villacoublay (FR)

( * ) Notice: Subject to any disclaimer, the term of this patent is extended or adjusted under 35 U.S.C. 154(b) by 0 days.

(21) Appl. No.: 09/581,223

(22) PCT Filed: Dec. 23, 1998

(86) PCT No.: PCT/FR98/02853

§ 371 (c)(1),
(2), (4) Date: Jun. 23, 2000

(87) PCT Pub. No.: WO99/34379

PCT Pub. Date: Jul. 8, 1999

(30) Foreign Application Priority Data

Dec. 23, 1997 (FR) ..... 97 16347

(51) Int. Cl.[7] ..... H01F 5/00
(52) U.S. Cl. ..... 336/200; 336/232
(58) Field of Search ..... 336/200, 232, 336/192, 107, 205–208, 83

(56) References Cited

U.S. PATENT DOCUMENTS 5,610,433 A * 3/1997 Merrill et al. ..... 336/200
5,952,909 A * 9/1999 Umeno et al. ..... 336/192
6,285,568 B1 9/2001 Taurand

FOREIGN PATENT DOCUMENTS

| | | | |
|---|---|---|---|
| DE | 2230587 | * | 1/1974 |
| EP | 0 371 157 | * | 6/1990 |
| EP | 0 807 941 | * | 11/1997 |
| JP | 09-102425 | * | 4/1997 |

* cited by examiner

*Primary Examiner*—Tuyen T. Nguyen
(74) *Attorney, Agent, or Firm*—Oblon, Spivak, McClelland, Maier & Neustadt, P.C.

(57) ABSTRACT

The invention concerns a planar transformer winding comprising primary and secondary coils with wire turns produced in the form of strip conductors formed on the surfaces of an insulting base and electrically connected with one another by means of conducting holes bored in the insulating base. The primary and secondary winding portions borne by one common surface of the insulating base are joined together by winding, along two distinct overlapping zones, spiral in shape, one of the zones joining side by side turns or portions of turns of the primary coil and the other zone joining together the turns or portions or turns of the secondary coil. Such an arrangement enables to obtain primary and secondary coils with a different number of turns on one single insulating base with two surfaces.

8 Claims, 5 Drawing Sheets

PLANAR TRANSFORMER WINDING

CROSS-REFERENCE TO RELATED APPLICATIONS

This application claims benefit of priority under 35 U.S.C. § 119 to French Application Serial No. 97/16347, filed on Dec. 23, 1997 and claims priority under 35 U.S.C. § 120 to Patent Cooperation Treaty Application Serial No. PCT/FR98/02853, filed on Dec. 23, 1998; the entire contents of which are incorporated by reference herein.

BACKGROUND OF THE INVENTION

1. Field of the Invention

The present invention relates to a coil for planar transformer comprising at least one primary winding and at least one secondary winding, and more particularly such a coil of the type whose primary and secondary windings comprise turns made in the form of conductive tracks formed on the faces of a plane insulating support or of several stacked plane insulating supports connected together, as need be, by conductive holes passing through the plane insulating supports.

2. Discussion of the Background

In planar technology, a transformer winding, which is either primary or secondary, consists of at least two portions of conductive tracks made on different faces of one or several stacked plane insulating supports in such a way as to be able to exhibit connection terminals arranged on the periphery of the transformer, this being so as to ease electrical connecting of the transformer. The portions of conductive tracks of one and the same winding follow similarly directed spirals and are connected together electrically so as to ensure the continuity of the winding, by the inside ends of their spirals and, as need be, by certain of the outside ends of their spirals by means of conductive holes passing through the insulating support or supports.

According to current practice, the conductive tracks of the primary and secondary windings of a transformer are nested on the plane insulating supports so that there is an alternation of primary and secondary turns on any one of the plane insulating supports, on moving from the outside towards the centre of a transformer.

Although generally proving satisfactory, this solution has certain drawbacks.

Firstly, when one wishes to have different numbers of loops for the primary and for the secondary of a planar transformer, this being relatively frequent, it is necessary firstly to make, on one or several stacked plane insulating supports, primary and secondary windings with the same number of loops corresponding to the smallest of the numbers of loops required. Then to terminate the winding having the largest number of loops with complementary turns traced on one or several other plane insulating supports. This may lead to the use of a high number of stacked plane insulating supports whereas it is important to reduce the number of stacked plane insulating supports as far as possible for ease of construction.

Moreover, since the turns of the primary and secondary windings are alternated on the surface of the plane insulating supports, it is necessary to provide therebetween a spacing making it possible to ensure the desired electrical insulation between the primary and secondary of the transformer. Since the constraints of electrical insulation between primary and secondary of a transformer are often sizeable, this generally results in a non negligible spacing between each of the primary and secondary turns traced alternately on the surface of one and the same plane insulating support. This inter-turn spacing reduces the density of the turns, hence the number of turns which can be housed on a given surface of plane insulating support. Apart from the fact that it limits the possibilities for diminishing the bulkiness of the transformer, it reduces the magnetic coupling thereby causing an increase in the magnetic leakages. This results in a transformer which is less effective than one might hope for, especially as regards efficiency.

SUMMARY OF THE INVENTION

The present invention aims to alleviate these drawbacks.

To this end, the subject of the invention is a coil for planar transformer comprising at least one primary winding and at least one secondary winding with turns made in the form of conductive tracks formed on the faces of an insulating support and connected together by means of conductive holes drilled in the insulating support, characterized in that the portions of the primary and secondary windings carried by one and the same face of the insulating support are grouped together on a per-winding basis, according to two separate nested zones, of spiral shape, one of the zones grouping together, side by side, turns or portions of turns of the primary winding and the other zone grouping together, side by side, turns or portions of turns of the secondary winding.

Such a structure, although complex from the geometrical point of view, does not exhibit any more technological difficulties to be constructed than that of the prior art.

On the other hand, it makes it possible to construct on the two faces of one and the same plane insulating support, an entire coil, comprising primary and secondary windings having different numbers of loops. A transformer made according to the invention can therefore comprise fewer layers of supports, even if it generally has several of them, and consequently be less expensive and less voluminous.

It furthermore makes it possible to pack the turns closer together within one and the same zone on a plane insulating support face since they belong to one and the same primary or secondary winding for which the requirements of inter-turn insulation are always lesser than the requirements of insulation between primary and secondary windings. This makes it possible to improve the compactness of the transformer and hence to limit its magnetic losses.

In a particular embodiment of the invention, each winding portion forms a turn which extends over approximately 360°.

This layout has the advantage of being simple, since it leads easily to complete turns when two portions of winding are connected together electrically by a conductive hole joining the inside ends of their turns.

Also in a particular embodiment, one at least of the windings is formed on each face of the support of a plurality of winding portions joined successively from one face to the other of the support, in series by conductive holes.

It will be seen hereinbelow that this layout, which is also geometrically complex, makes it possible to arrange for numerous turns of the primary winding (respectively secondary winding) to be opposite the secondary winding (respectively primary winding).

Advantageously, the turns of each winding have shapes such that they create superposed indentations through which the conductive holes of the other winding pass.

Such an arrangement allows the best possible superposition of the primary and secondary windings, and it thus makes it possible to improve the magnetic performance of the transformer.

The subject of the present invention is also a multiple coil for planar transformer, comprising a plurality of coils as described hereinabove arranged one above another on a plurality of assembled supports, the primary and secondary windings respectively of the said coils being electrically linked to one another.

The said windings may then be linked either in series, or in parallel.

Provision may furthermore be made for several primaries and/or several secondaries.

BRIEF DESCRIPTION OF THE DRAWINGS

A particular embodiment of the invention will now be described by way of non-limiting example, with reference to the appended diagrammatic drawings in which.

DESCRIPTION OF THE PREFERRED EMBODIMENTS

It will be noted that the insulating supports onto which the conductive tracks whose layout forms the subject of the present invention are perfectly known in themselves, as is the manner of superposing them, and of forming conductive tracks on their faces, for example by printing with conductive ink or affixing a metal foil.

Figure 1:
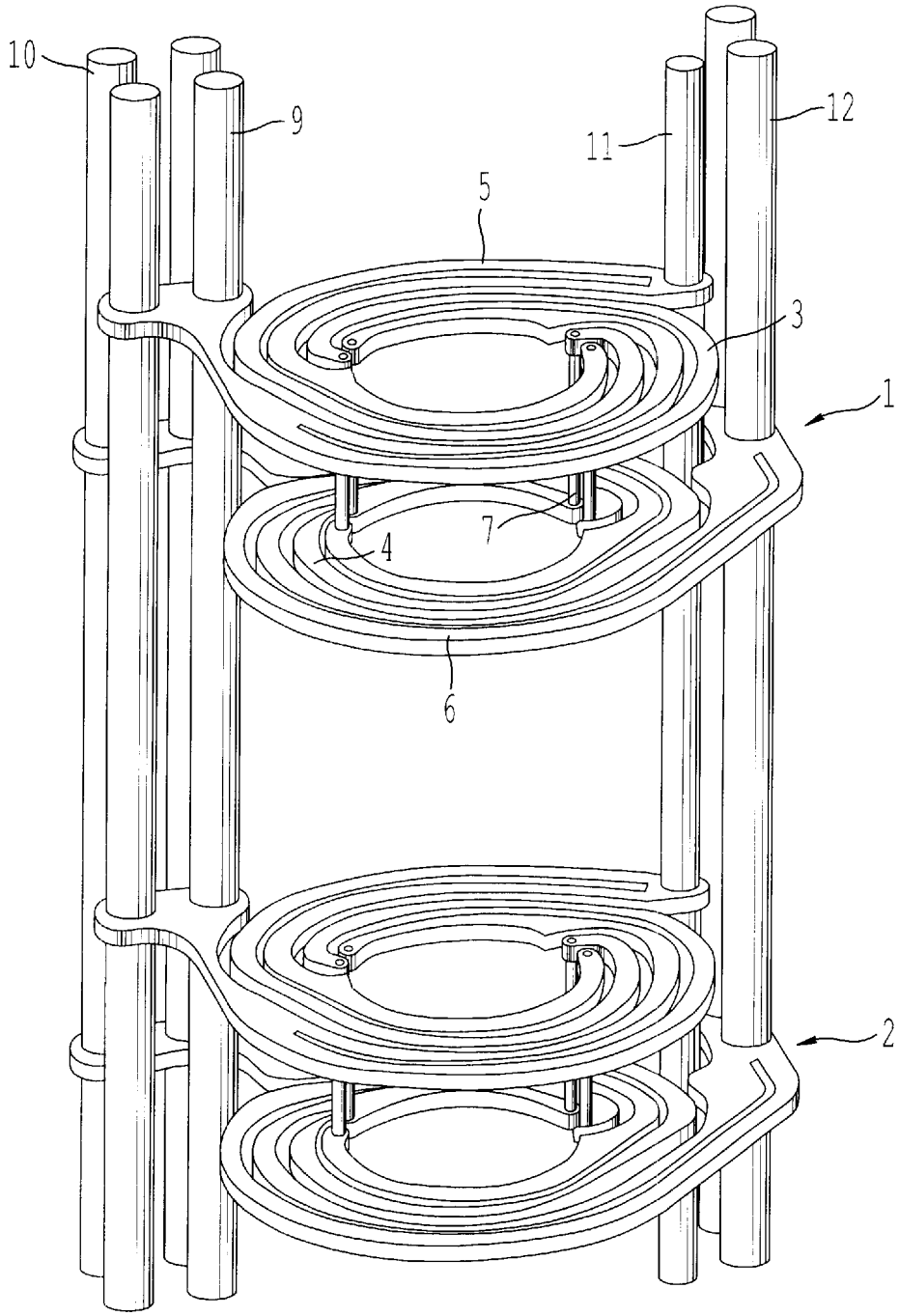
FIG. 1 is a perspective view of a transformer coil according to the invention.

FIG. 1 shows two identical elementary coils 1 and 2 joined together as a multiple coil. Each of the coils is formed of a primary winding and of a secondary winding, nested together, each being made partially on each of the faces, upper and lower, of the support on which this elementary coil is formed.

The primary winding, for example, is formed of a first conductive span 3 extending over approximately 360° around the axis of the coil, so as to form a first turn on the upper face of the support, and of a second conductive span 4 also extending over approximately 360° around the axis of the coil, so as to form a second turn on the lower face of the support. In the same way, the secondary winding is formed of a first conductive span 5 extending over approximately 360° around the axis of the coil, so as to form a first turn on the upper face of the support, and of a second conductive span 6 also extending over approximately 360° around the axis of the coil, so as to form a second turn on the lower face of the support.

The various aforesaid spans, and hence the turns which result therefrom, are not circular but substantially helical, so that the first few turns of each winding are nested on the upper face of the support, as are the second few turns on its lower face. In the present case or [sic] each winding comprises just one turn per face, this signifies that each turn of each winding passes between the ends of the turn, formed on the same face of the support, of the other winding.

Moreover, each turn possesses a free end, the connection of which will be described hereinbelow.

Figure 2:
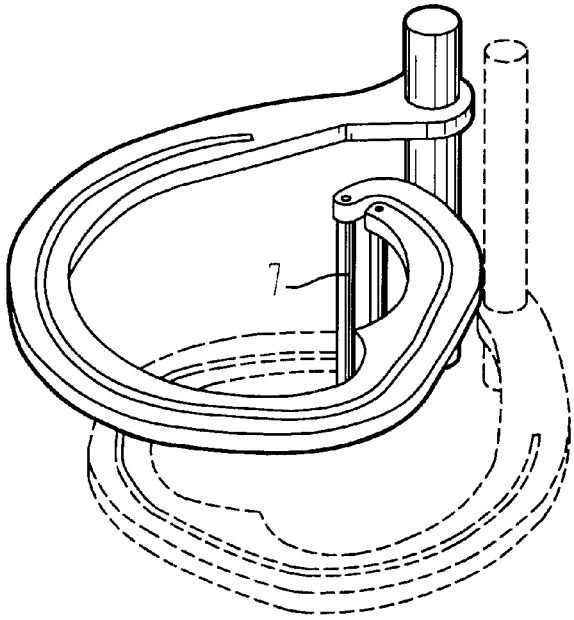
FIGS. 2 and 3 illustrate, respectively in perspective and in plan view, a portion of winding according to the invention.

The other end of each turn of each winding lies, on a face of the support, opposite the other end of the turn of the same winding, on the other face of the support. These opposed ends are linked by conductive holes 7 (FIG. 2) so as to ensure the electrical continuity of each winding from one of its free ends to the other.

Figure 3:
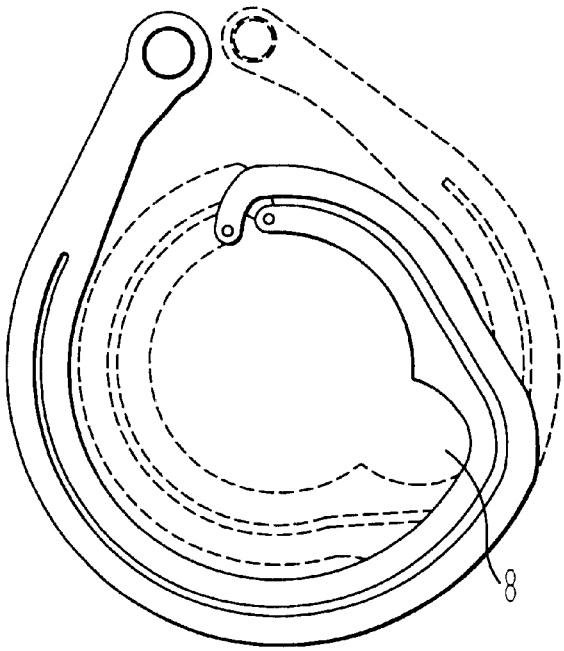

It will be observed, and more particularly in FIG. 3, that the turns of each winding have shapes such that they create superposed indentations 8. The conductive holes of the other winding pass through these indentations, thereby making it possible to ensure optimal overlapping of the primary and secondary windings, and hence good performance from the magnetic point of view.

The free ends of the primary winding are linked to two linking conductors 9 and 10 (here, double) perpendicular to the plane of the support and arranged side by side. Likewise, the free ends of the secondary winding are linked to two similar linking conductors 11 and 12 (of which one, here, is double). The linking conductors of the primary and of the secondary are made in a known manner in the form of conductive holes, when assembling the superposed supports.

Figure 4:
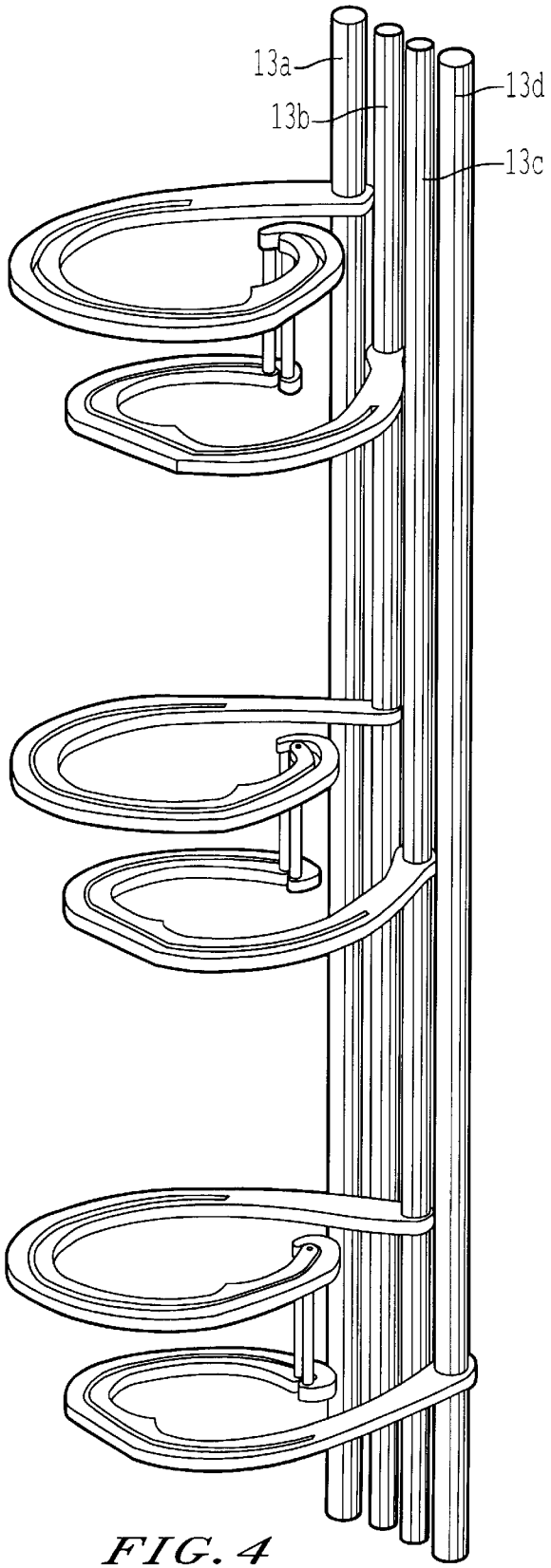
FIG. 4 illustrates another embodiment of a coil according to the invention, a single winding being represented.

The primary windings on the one hand, and the secondary windings on the other hand, of the coils 1 and 2 are here connected in parallel. FIG. 4 shows however a multiple winding, primary or secondary, where three elementary windings are connected in series with four conductive holes 13*a*–13*d*. The layout of FIG. 4 does not differ otherwise from that of FIG. 1 and will therefore not be described in greater detail.

It will have been appreciated that all the conductive spans represented hitherto in the drawings are split into two. This constitutes a known arrangement related to the fact that the current is not uniformly distributed over a given conductor on proceeding from the axis of the turn towards the outside. Each winding is therefore divided into two conductors, each of these conductors passing to the inside on one of the faces of the support and to the outside on the other face, thereby making it possible to optimize the alternate resistances by forcing the same current through the two branches.

Figure 5:
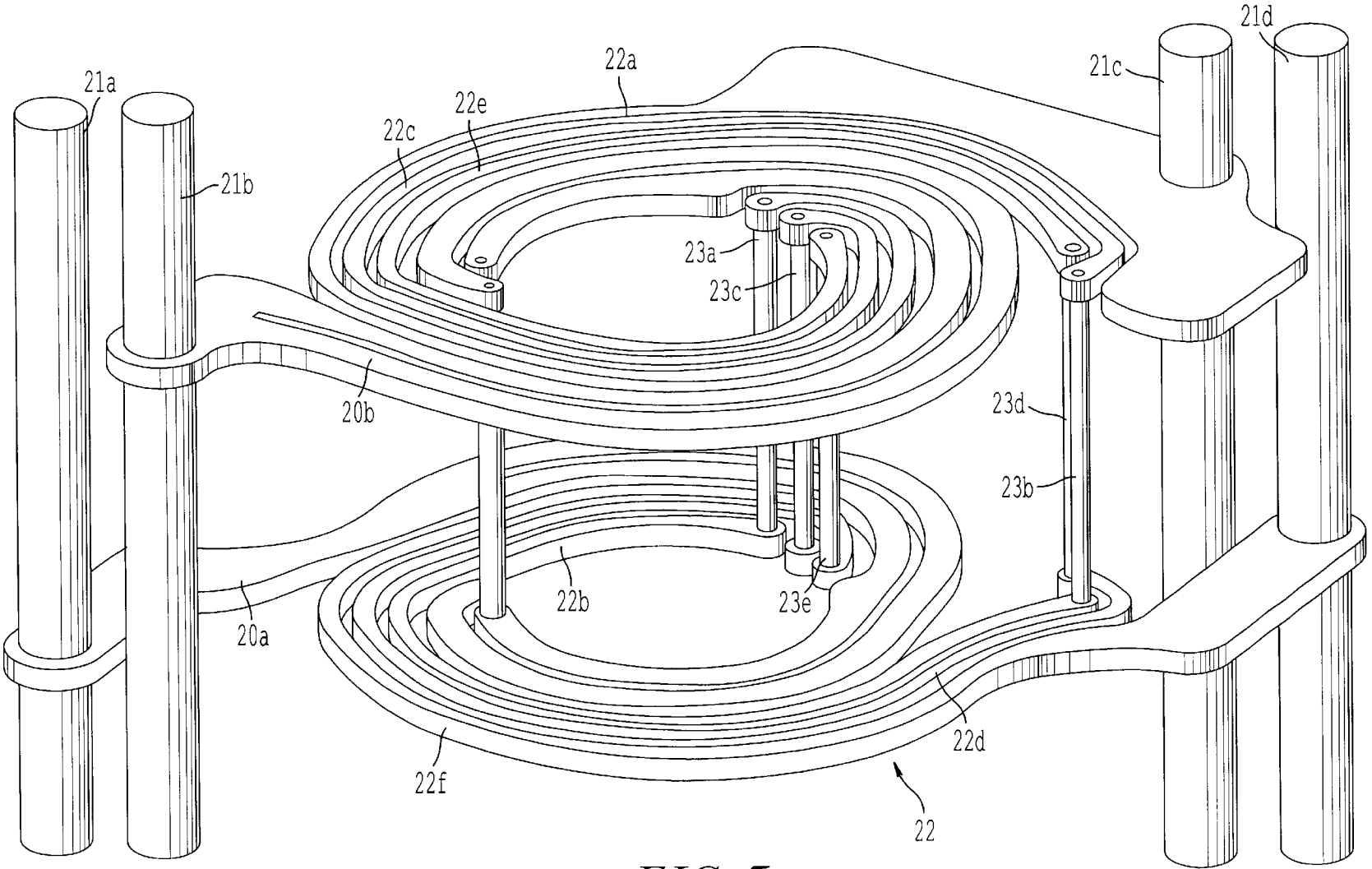
FIG. 5 is a perspective view of another embodiment of the invention.
Figure 6:
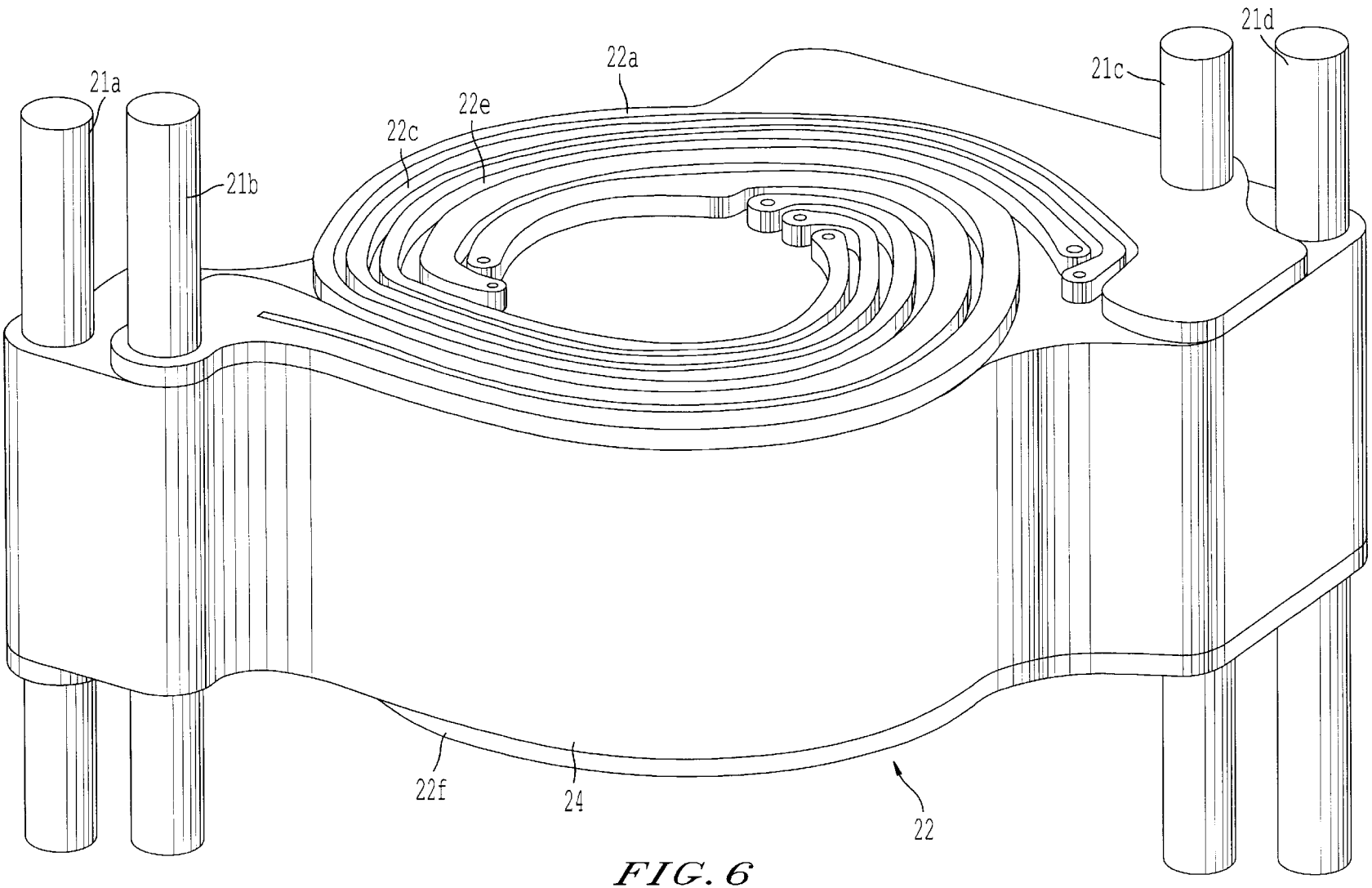
FIG. 6 is another view of the embodiment of the invention shown in FIG. 5, the insulating support being represented.

Reference will now be made to FIGS. 5 and 6 (in which only one of the windings is split into two as described in the above paragraph). Regarding FIG. 6, an insulating support 24 is shown. The insulating support has first and second opposing faces on which the primary and secondary windings are provided as described below. Regarding FIG. 5, the primary winding (for example) 20 and the connections of the windings to the conductive holes 21*a*–21*d* are identical to those of FIG. 1 Hence, only the secondary windings will be described.

The latter is formed of six helical spans each extending over substantially 360°, thus forming six turns, three on one face of the support and three on the other face. The first turn 22*a* extends over the upper face of the support from the conductive hole 21*c*, on the outside of the coil, to the inside of the coil. The winding then continues through a conductive hole 23*a* where it passes through the support. The second turn 22*b* therefore extends over the lower face of the support, from the conductive hole 23*a* up to another conductive hole 23*b*, in proximity to the conductive hole 21*c*. The third turn 22*c* again extends over the upper face, on the inside of the turn 22*a*, from the conductive hole 23*b* up to the conductive hole 23*c* in proximity to the conductive hole 23*a*. The winding thus continues in series via the turn 22*d*, the conductive hole 23*d*, the turn 22*e*, the conductive hole 23*e*, and the turn 22*f*, which is connected to the conductive hole 21*d*.

It is observed that the three turns 22*a*, 22*c* and 22*e* of the secondary winding 22 which are carried by the upper face of the support, are arranged side by side in one and the same zone reserved so to speak for the secondary winding 22. This spiral-shaped zone is nested with another likewise spiral-shaped zone which is itself reserved for the split turn 20*b* of the primary winding 20. This same arrangement of the turns in two zones in the form of nested spirals, one reserved for the turns of the primary winding and the other for the turns of the secondary winding, is found also on the other face of the support. This arrangement makes it possible, as has just been seen, to make primary and secondary windings with different numbers of turns, here a primary winding with a turn split into two and a secondary winding with six single turns, while employing only one support with two faces. It also allows better use of copper because the insulation distances to be complied with within each zone are lesser since only inter-turn insulation within one and the same winding is involved.

The coil just described in relation to FIG. 5 can obviously be associated with others in parallel or in series, as in FIGS. 1 or 4 respectively.

What is claimed is:

1. A coil for a planar transformer comprising:

an insulating support having first and second opposing faces;

a first primary winding portion provided on the first face of the insulating support and including a plurality of turns formed of conductive tracks;

a second primary winding portion provided on the second face of the insulating support and including a plurality of turns formed of conductive tracks;

a first secondary winding portion provided on the first face of the insulating support and including a plurality of turns formed of conductive tracks;

a second secondary winding portion provided on the second face of the insulating support and including a plurality of turns formed of conductive tracks; and at least a first linking conductor configured to connect the first primary winding portion to the second primary winding portion and at least a second linking conductor configured to connect the first secondary winding portion to the second secondary winding portion through the insulating support;

wherein the turns of the first primary winding portion are grouped together side by side around or inside the turns of the first secondary winding portions which are grouped together side by side on the first face of the insulating support and the turns of the second primary winding portion are grouped together side by side around the turns of the second secondary winding portion which are grouped together side by side on the second face of the insulating support.

2. Coil according to claim 1, characterized in that each winding portion carried by a face of the insulating support forms a turn which extends over approximately 360°.

3. Coil according to claim 1, characterized in that the turns of each winding are shaped such that they create superposed indentations through which the linking conductors pass.

4. Multiple coil for planar transformer, characterized in that it comprises a plurality of coils according to claim 1, arranged one above another on a plurality of assembled supports and connected together electrically, primary winding to primary winding and secondary winding to secondary winding by linking conductors drilled through the assembled supports.

5. Coil according to claim 4, characterized in that the said windings are linked in series.

6. Coil according to claim 4, characterized in that the said windings are linked in parallel.

7. Coil according to claim 4, characterized in that it comprises at least several primary coils or several secondary coils.

8. Coil according to claim 1, wherein at least one turn of the first primary winding is connected in series with one of the turns of the second primary winding via one of the linking conductors and at least one turn of the first secondary winding is connected in series with one of the turns of the second secondary winding via one of the linking conductors.

* * * * *